US005154363A

United States Patent [19]

Eddy

[11] Patent Number: 5,154,363

[45] Date of Patent: Oct. 13, 1992

[54] RECIPROCATING ACTION MILLER

[76] Inventor: William A. Eddy, 11506 Glenora, Houston, Tex. 77065

[21] Appl. No.: 575,918

[22] Filed: Aug. 31, 1990

[51] Int. Cl.[5] ..... B02C 13/286

[52] U.S. Cl. ..... 241/30; 241/186.3; 241/190; 241/224; 241/243

[58] Field of Search ..... 241/DIG. 38, 101.7, 241/30, 190, 194, 186 R, 189 R, 294, 280, 281, 186.4, 189 A, 186.2, 57, 186.3, 27, 243, 224

[56] References Cited

U.S. PATENT DOCUMENTS

| | | | |
|---|---|---|---|
| 1,818,570 | 8/1931 | Mursch | 241/190 |
| 3,195,592 | 7/1965 | Hall | 241/189 R X |
| 3,587,983 | 6/1971 | Heinrich | 241/189 R X |
| 3,615,059 | 10/1971 | Moeller | 241/189 R X |
| 4,087,051 | 5/1978 | Moeller | 241/190 X |
| 4,106,706 | 8/1978 | Burrows | 241/189 R X |
| 4,412,659 | 11/1983 | Crawford et al. | 241/57 X |
| 4,767,066 | 8/1988 | Williams | 241/190 X |

FOREIGN PATENT DOCUMENTS

| | | | |
|---|---|---|---|
| 1468662 | 3/1977 | United Kingdom | 241/190 |

*Primary Examiner*—P. W. Echols
*Attorney, Agent, or Firm*—James R. Young

[57] ABSTRACT

A self-contained reciprocating action miller having a grinding mill housed within a mill housing and rotating about a grinding axis. A refuse hopper mounted above the mill housing has a convex floor with an opening therein to expose the grinding mill. Reciprocating feed apparatus mounted within the refuse hopper reciprocates two parallel, spaced-apart vertical walls along an axis parallel to the grinding axis to gradually feed the refuse into the grinding mill at a steady rate to prevent jamming of the mill when grinding tough refuse. Shear plates in the form of segments of a circle are positioned adjacent the rotor for comminuting shreddable or grindable material while guiding noncomminutable materials through the mill. A reversible rotor, stator, and discharge chute allow the comminuted material to be discharged from either side of the mill with no loss of grinding efficiency.

27 Claims, 7 Drawing Sheets

RECIPROCATING ACTION MILLER

BACKGROUND OF THE INVENTION

1. Field of the Invention

This invention relates to grinding and comminuting apparatus in general, and in particular to an industrial hammer mill having a reciprocating feed, reversible operation, and special shear plates in the grinding stator to increase comminuting efficiency while reducing jamming of and damage to the mill by refuse that cannot be comminuted.

2. Brief Description of the Prior Art

Grinding mills have been utilized for some time in a variety of applications. For example, grinding mills have been commonly used in the past for grinding grains, corn, hay, and other forage materials for livestock feed, as well as paper for cellulose insulation and other commercial uses. Many varieties of grinding mills for comminuting such materials have been developed, such as stone mills, burr mills, hammer mills, and roller mills. Because forage materials tend to be fibrous and stalky, hammer mill type grinders have been found to be the most effective in comminuting these forage or roughage materials. However, handling and feeding these bulky, fibrous, stalky materials into a hammer mill in a uniform manner proved to be quite difficult and required a good deal of tedious manual labor, because they do not flow in a uniform manner like grains.

Some of the more recent developments in larger grinding apparatus to alleviate the problems in feeding bulky, fibrous, and stalky materials into hammer mills include the grinders now known generically as tub grinders because of their rotating tub feeders. Typical examples of such tub grinders can be found in the following patents: U.S. Pat. No. 2,659,745, issued to W. Wortman; U.S. Pat. No. 3,615,059, issued to E. Moeller; U.S. Pat. No. 3,743,191, issued to R. Anderson; U S. Pat. No. 3,912,175, issued to R. Anderson; U.S. Pat. No. 3,966,128, issued to J. Anderson, et al.; U.S. Pat. No. 4,003,502, issued to E. Barcell; U.S. Pat. No. 4,087,051, issued to C Moeller; and U.S. Pat. No. 4,106,706, issued to H. Burrows. These tub grinders were designed initially to feed very large bales of hay and other forage materials into hammer mill apparatus without the need for excessive manual labor. Tub grinders come in various sizes depending on the type of duty for which they are designed, but all have relatively large rotating tubs positioned over the hammer mill cylinders for containing bales or piles of forage material and feeding the forage material gradually into the hammer mills. In a typical tub grinder, the hammer mill cylinder is positioned under and extends partially through the floor or bottom of the tub, and the rotating tub feeds the bottom of the bale or pile of material to be comminuted over the hammer mill. The hammers on the hammer mill cylinder rotate at a high angular velocity and "chew" off the forage on the bottom of the bale as the base of the bale rotates over the hammer mill cylinder in the floor of the tub.

Such tub grinders are quite effective for grinding large quantities of forage or roughage materials. Therefore, with the exception of expensive, large, stationary grinders in more or less permanent industrial grinding installations with special, custom designed conveyors and other feed apparatus for specific purposes, the tub grinders have become the standard for larger, portable, mid-priced, general purpose grinding machines. Consequently, tub grinders are also now being used with marginal success for comminuting other kinds of bulky materials where large quantities of such materials have to be handled, and particularly where the materials are dumped into the hammer mill in batches, such as with a front end loader vehicle. For example, some tub grinders are being used to comminute waste materials, such as wood and other construction industry wastes, tree branches and landscaping waste, refuse, rubbish, and the like, and a few heavier duty models are being made especially for those uses.

Unfortunately, however, even the largest tub grinders or millers are not really well-suited to the task of such heavy waste or industrial grinding. The rotating tub concept, which worked so well for grinding hay bales that it revolutionized large scale, portable batch feed grinding, does not work as well with waste wood, cement chunks, metal, and other materials from construction sites, tree branches and grass and weed cuttings from landscape maintenance operations, refuse, rubbish, volcanic rock, and the like.

In the past, there was not a great need for grinding mills that could reliably grind such tough or odd-shaped materials, since most of these materials were simply hauled to the nearest landfill site for disposal. Nowadays, however, the decreasing availability of landfills for rubbage or refuse disposal has placed a greater emphasis on the need to transform such materials into more compactable and readily decayable forms before disposal. Consequently, most local and municipal governments are beginning to require city workers to grind waste materials, such as large tree branches, wood, assorted rubbish, and other waste collected from parkways, parks, schools, etc., into more readily decayable forms before hauling them to the landfills, thereby easing the refuse disposal problem. Moreover, this idea of grinding rubbish or refuse into a more disposable and quickly decayable form is spreading into other areas, such as garbage collection companies, which have to dispose of large amounts of these materials. Therefore, there is a steadily increasing need for an industrial grinder or miller that is capable of grinding large quantities of such difficult or heavy materials more reliably and efficiently. Such an industrial grinder should be capable of reliably grinding all types of shreddable materials such as garbage, refuse, waste, glass, plastics, paper, clay, wood, branches, yard waste, manure, bark, wet leaves, grass clippings, weeds, compost, and other common, but shreddable waste materials, yet not jam when certain non-comminutable material, such as chunks of metal, rock, or concrete might accidently find its way into the mill.

Further, because of the very common use of front end loader vehicles to handle and move such waste materials, the industrial grinder should be capable of receiving fairly large batch quantities of such materials and feeding them uniformly and efficiently into the hammer mill rotor for comminuting. It should also be capable of handling not only bulky, irregular-shaped objects, but also capable of taking occasional chunks of non-comminutable material, such as metal, rock, concrete, and other hard objects without damaging or jamming the hammer mill rotor or concave apparatus. Prior to this invention, no such industrial grinder existed

SUMMARY OF THE INVENTION

Accordingly it is an object of this invention to provide an industrial grinder particularly adapted for grinding a variety of waste and other materials that heretofore were difficult to handle, feed, and grind in large, batch quantities.

It is another object of this invention to provide an industrial grinder with a jam-resistant grinding mechanism.

It is yet another object of this invention to provide an industrial miller with a batch container feed apparatus that is capable of reliably and gradually feeding a wide variety odd-shaped and difficult to handle, bulky materials into the grinding mechanism.

It is still yet another object of this invention to provide an adjustable grinding mechanism to vary the sizes of the comminuted fragments.

It is a further object of this invention to provide an industrial miller having a reversible grinding apparatus and discharge chute to discharge the comminuted material from either side of the miller.

It is still yet a further object to provide an industrial miller that is capable of handling large batch quantities of industrial waste, yet which is mobile and self-contained.

To achieve the foregoing and other objects and in accordance with the purpose of the present invention, as embodied and broadly described herein, the self-contained reciprocating action miller of this invention may comprise a grinding rotor housed within a mill housing and rotating about a grinding axis, a refuse hopper mounted above the mill housing with a convex floor, and an opening in the floor to expose a portion of the grinding mill. Reciprocating feed apparatus mounted within the refuse hopper includes two parallel, spaced-apart vertical walls that are moveable in a reciprocating manner along an axis parallel to the grinding axis for gradually feeding the refuse into either cutting end of the grinding rotor at a steady rate. A set of shear plates are positioned on a moveable concave or stator adjacent a portion of the peripheral surface of the mill or grinding rotor for interaction with the mill rotor in comminuting materials in the mill housing, but which are also positioned to provide inclined surfaces for guiding chunks of hard, non-comminutable materials through the mill housing. A reversible rotor, stator, and discharge chute allow the comminuted material to be discharged from either side of the mill with no loss of grinding efficiency. Several other features are also included to enhance the performance and reliability of the grinder.

The method of this invention includes alternately feeding the material to be comminuted to either cutting end of the grinding rotor, whereupon the material is pulled into the mill housing and comminuted by the action of hammers attached to the rotating grinding mill and the moveable concave or stator. After being comminuted, the material is ejected from the mill housing by the rotation of the hammers.

Additional objects, advantages and novel features of the invention shall be set forth in part in the description that follows, and in part will become apparent to those skilled in the art upon examination of the following or may be learned by the practice of the invention. The objects and the advantages of the invention may be realized and attained by means of the instrumentalities and in combinations particularly pointed out in the appended claims.

BRIEF DESCRIPTION OF THE DRAWINGS

The accompanying drawings, which are incorporated herein and form a part of the specification, illustrate the preferred embodiments of the present invention and, together with the description, serve to explain the principles of the invention. In the drawings.

DETAILED DESCRIPTION OF THE PREFERRED EMBODIMENT

Figure 1:
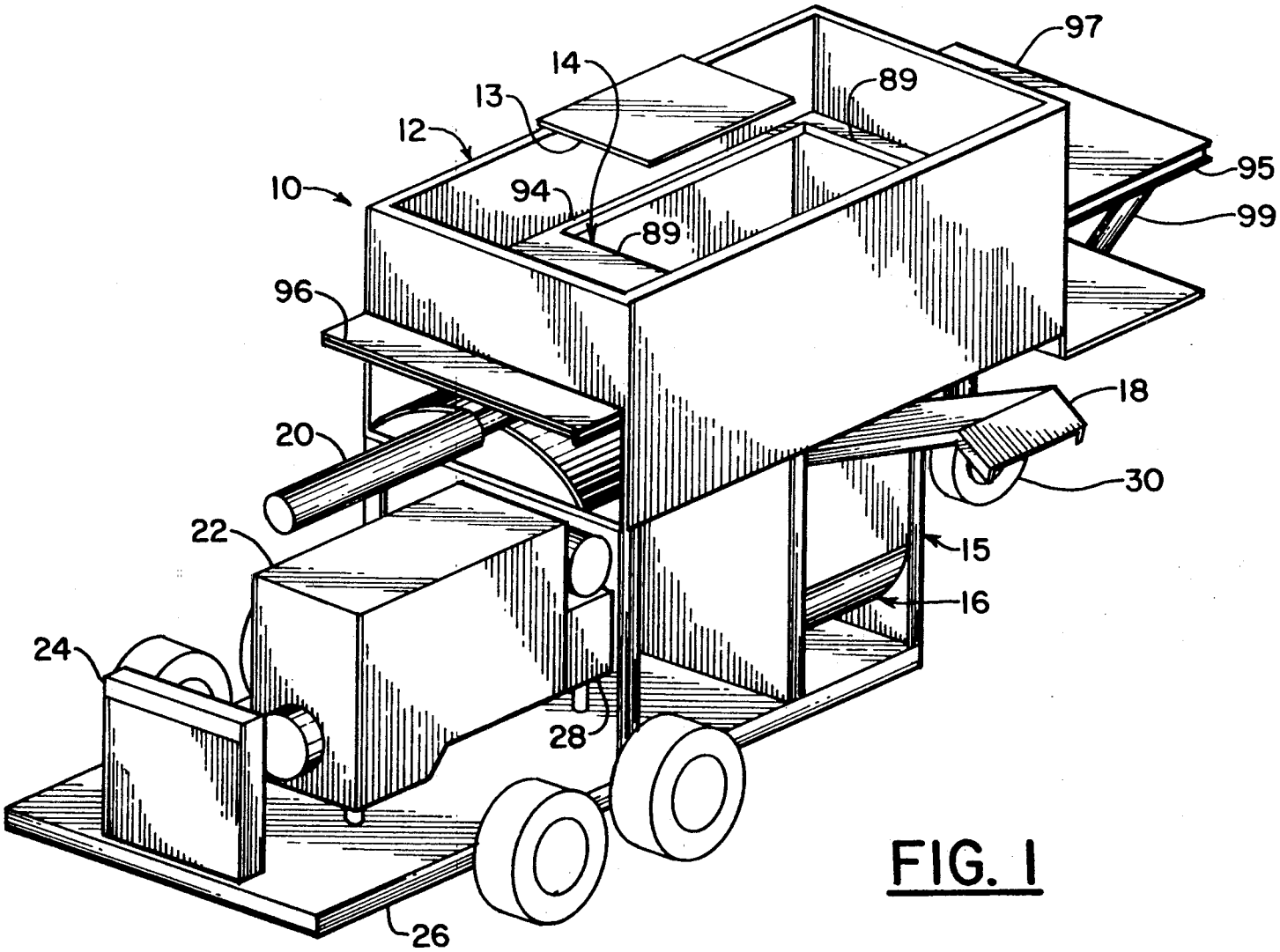
FIG. 1 is a perspective view of the reciprocating action miller of the present invention showing the overall arrangement of the components of the miller.
Figure 8:
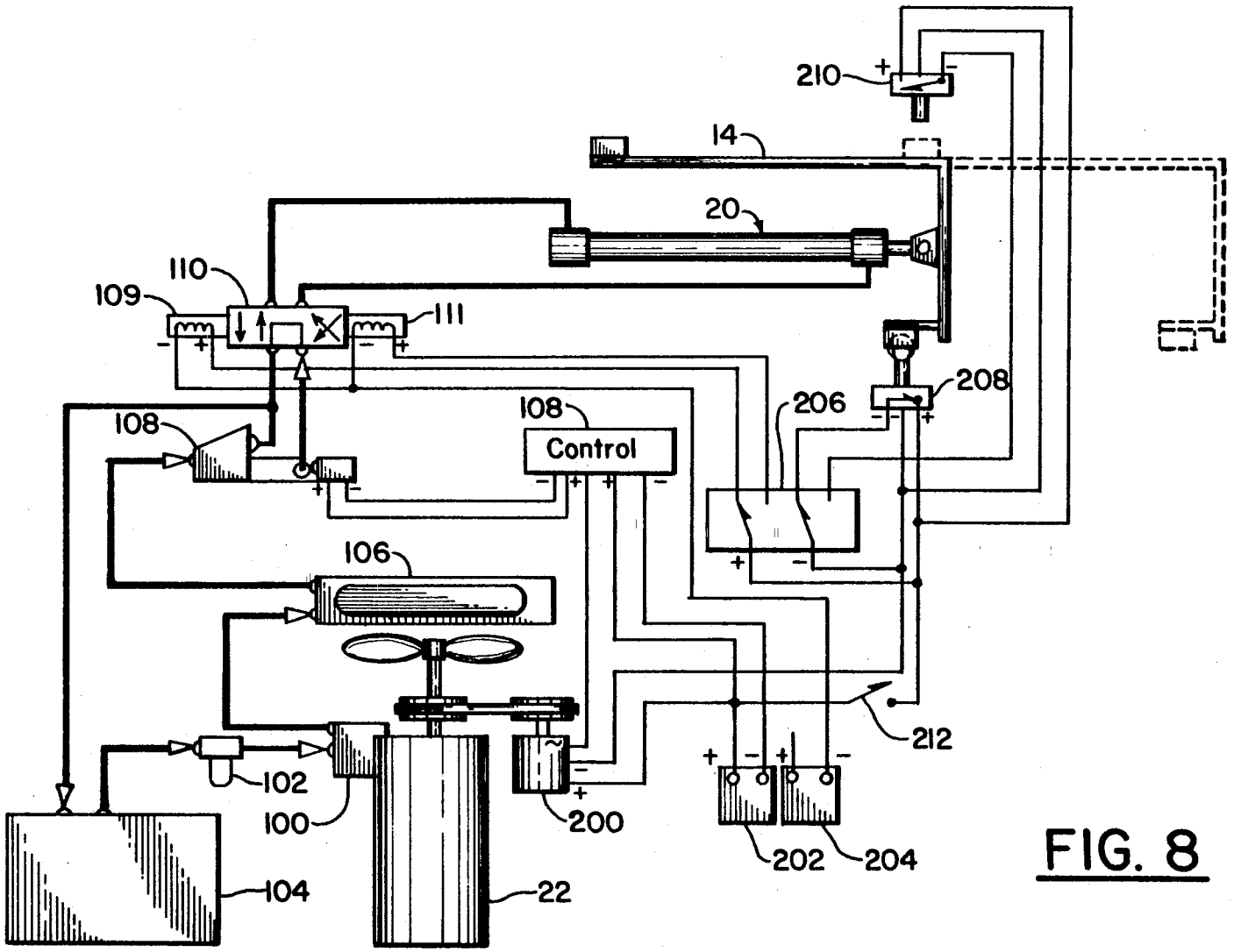
FIG. 8 is a schematic diagram of an electrical and hydraulic system that can be used to reciprocate the feed mechanism according to this invention.

The reciprocating grinder or miller 10 of the present invention is shown in FIG. 1 and comprises a hopper 12 mounted over a hammer or grinding mill housing 15, which houses a concave stator 16 and a grinding rotor 46 (not shown in FIG. 1, but shown in FIG. 2), and a reciprocating feed mechanism 14. A splinter guard 13 may be optionally attached to the top of hopper 12 to prevent splintered refuse from flying out of the hopper 12. A wheeled chassis 26 supports the mill housing 15 and hopper 12, along with engine 22, radiator 24, reversible transmission 28, and other associated hydraulic pumps and miscellaneous apparatus (not shown in FIG. 1, but shown schematically in FIG. 8), required to drive the reciprocating feed mechanism 14 and grinding rotor 46, as will be described in more detail below.

In operation, the refuse, garbage, or other material to be comminuted (not shown) is deposited into the hopper 12, usually in batches, and is axially fed into either cutting end of the grinding rotor 46 by reciprocating feed mechanism 14, which is reciprocated back and forth across the interior of hopper 12 by hydraulic cylinder 20, as will be described in more detail below. The reciprocating feed mechanism 46 pushes and sweeps the material to be comminuted over an opening 17 (FIG. 3) in the floor of the hopper 12 and into grinding rotor 46, which protrudes upwardly into the hopper 12 through said opening 17 in the floor of the hopper 12. Projections, such as hammers extending radially outward from the periphery of the grinding rotor 46 (FIG. 3) tear at the material in the hopper 12 adjacent the opening 17 and pull it down into the grinding mill housing 15, where it is comminuted and discharged. The direction of the ejected discharge is guided by adjustable discharge chute 18, shown in FIG. 1.

Figure 2:
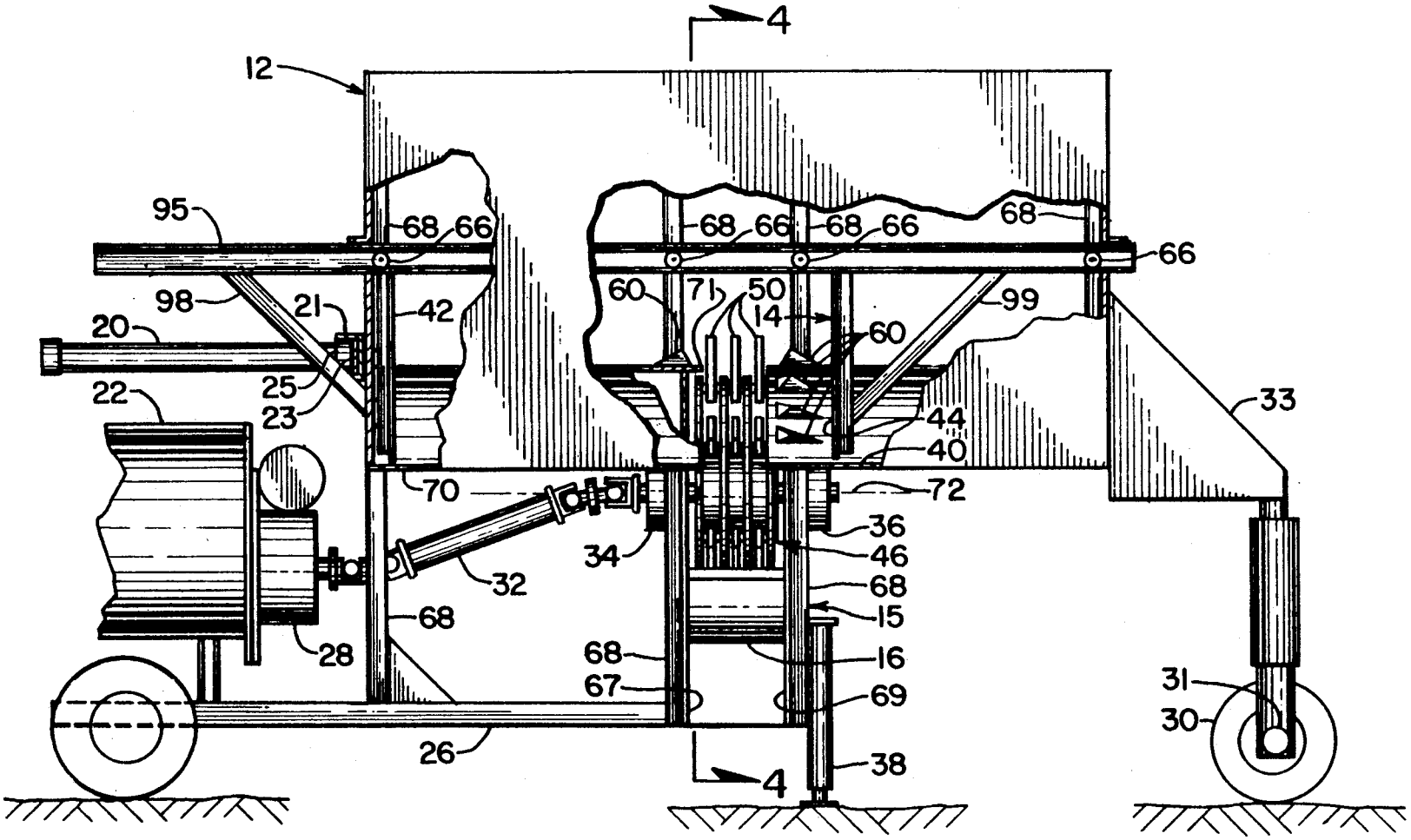
FIG. 2 is a side view in elevation of the reciprocating action miller of the present invention with part of the hopper broken away to show the reciprocating feed, log ramps, and grinding rotor.

An adjustable jack stand 38 is shown in FIG. 2 attached to the front of the mill housing 15 for supporting the front of the miller 10 during use. A conventional goose neck connection 33 is provided extending from the front of the hopper 12 for connecting to a truck in a conventional manner for towing from one place to another. Finally, an optional pivotally mounted pilot or maneuvering wheel 30, which can be rotated by a hydraulic motor 31 for self-propulsion (FIG. 2), can be used to move or propel the entire reciprocating action miller 10 from place to place, particularly for short distances in the vicinity of the grinding operation, without having to hook up and tow it with another vehicle.

In the preferred embodiment, the reciprocating action miller 10 of the present invention is quite large in size and built very heavy and tough to perform well in industrial grinding conditions. The hopper 12, for example, is preferably sized to receive and contain at least 6 to 12 cubic yards, which can hold several buckets full from a large front end loader, or even an entire load from a conventionally sized dump truck or garbage truck. The miller 10 need not necessarily be of this large size, and it can be made smaller if desired. However, if the mill is downsized too much, it will lose its ability to comminute larger, tough materials, because of the reduced rotational inertia and physical strength of such a downsized grinding rotor 46. Thus, the overall large size of the miller 10 of the preferred embodiment enhances its ability to comminute tough materials and to handle chunks, such as metal, rock, or concrete because of the high inertia of the large-sized grinding rotor 46 and the heavy components comprised in its structure. Moreover, the large size of the machine 10 increases material throughput such that it can quickly comminute large amounts of refuse in an industrial environment for which it was designed. Finally, as mentioned above, the stationary hopper 12 with reciprocating feed mechanism 14 enhances the feed operation of the miller, simplifies construction, and reduces cost by dispensing with the need for large, complex, and cumbersome rotating tubs or other specialized conveyors and feed apparatus.

Other unique features of this invention, which will be described in detail below, include an adjustable, jam-resistant grinding stator 16, which is easily adjustable to regulate the sizes of the comminuted fragments discharged by the miller. Furthermore, the grinding stator 16 and discharge chute 18 are also designed to be easily switchable from one side of the symmetrical mill housing 15 to the other, thus allowing the comminuted material to be discharged from either side of the miller 10. When the grinding stator 16 is moved from one side to the other, the direction of rotation of the grinding rotor 46 must also be changed. This change of rotation of the rotor 46 is easily accomplished in this invention by driving the grinding rotor 46 via a fully reversible transmission 28.

Figure 3:
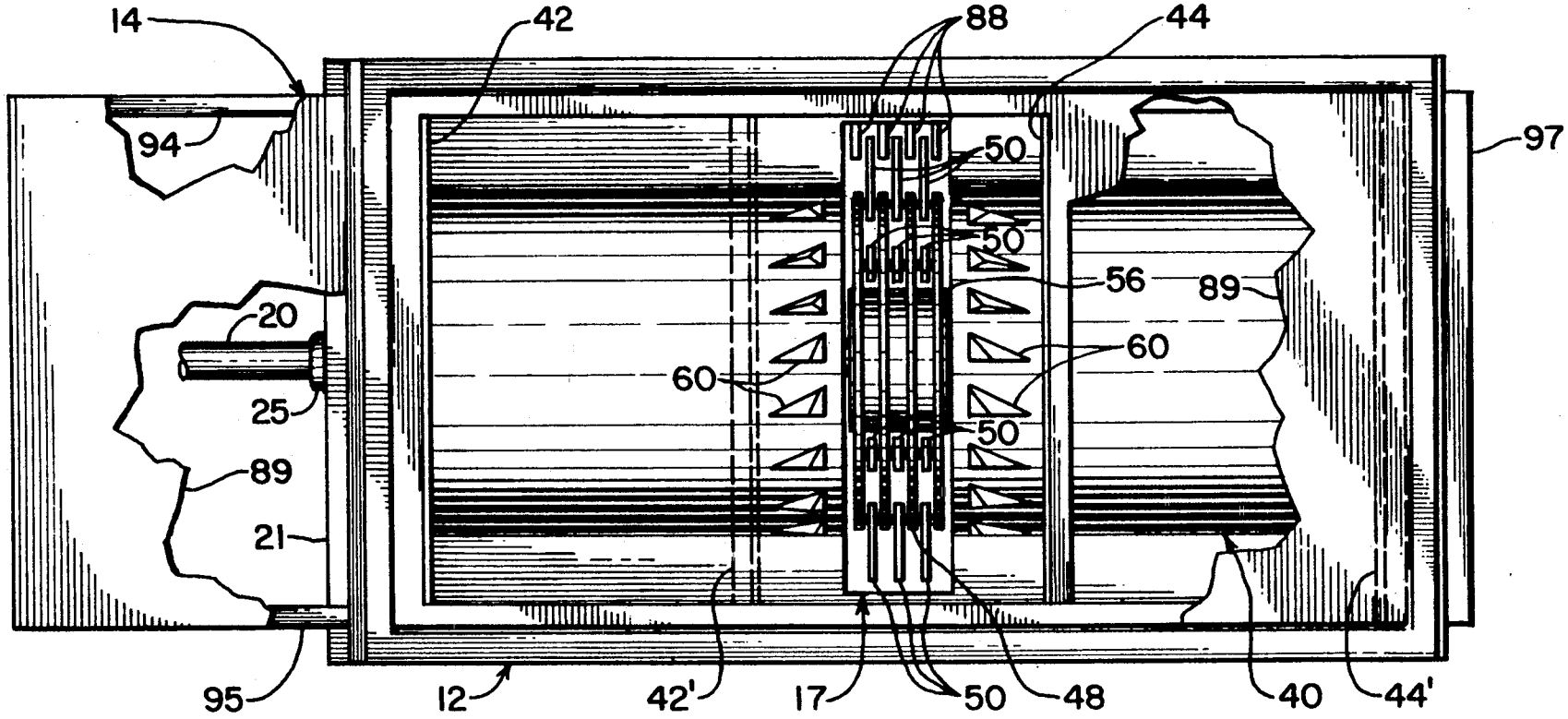
FIG. 3 is a plan view of the reciprocating action miller of the present invention with part of the decking plates of the feed apparatus broken away to more clearly show the structure thereof.
Figure 4:
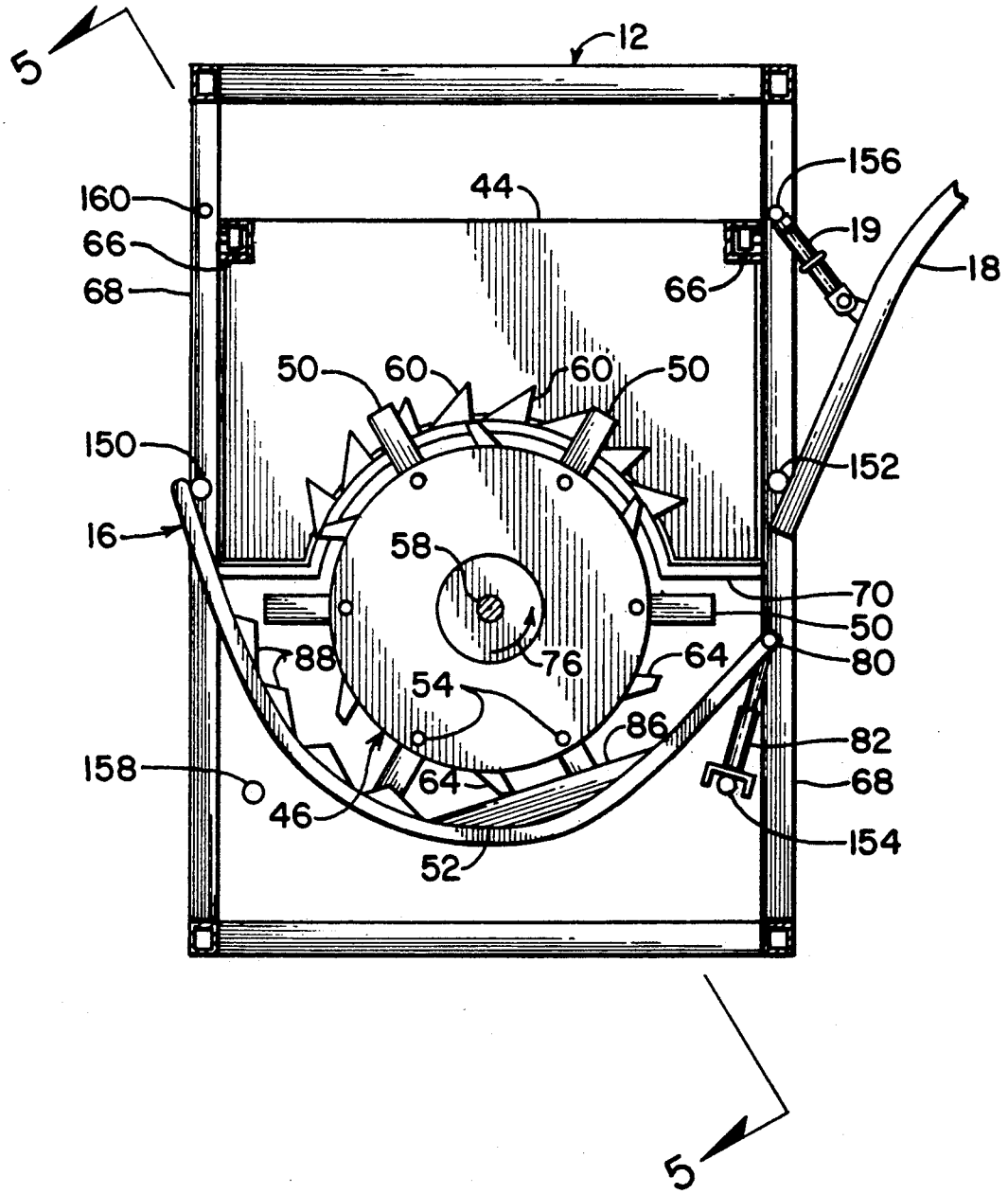
FIG. 4 is a cross-sectional view of the reciprocating action miller taken along the line 4—4 of FIG. 2, showing the arrangement of the grinding rotor and the eccentric, adjustable stator.

The structural details of the reciprocating action miller 10 of the present invention are best understood by referring to FIGS. 2, 3, and 4 simultaneously. Specifically, rotatable grinding rotor 46 is mounted on a shaft 58 that is journaled in bearings 34, 36. These bearings 34, 36 are mounted on the forward and aft vertical sidewalls 69, 67, respectively, of mill housing 15. The grinding rotor 46 is rotated about grinding rotor axis 72, which may also be called an axis of rotation or rotation axis of a cylinder defined by the rotating rotor 46 and hammers 50, by the engine 22 via the fully reversible transmission 28 and driveshaft 32. Grinding concave or stator 16 is disposed below rotor 46, also between the forward and aft vertical sidewalls 69, 67 of mill housing 15, as will be fully described below.

Hopper 12, positioned over the mill housing 15, is essentially a four sided enclosure having a floor 70 of convex cross-section with a central aperture or slot 17 through which the projections, such as the mill hammers 50 and chipping knives 64 (FIG. 4), pass as they are rotated by rotor 46. Hopper 12 also houses the reciprocating feed 14, which is supported by guide rollers 66 attached to vertical cross members 68 of hopper 12. As mentioned above, a maneuvering wheel 30 can be optionally attached to support structure 33 to allow the miller 10 to be more easily moved from place to place. Alternatively, jack stand 38 attached to the vertical cross member 68 of mill housing 15 can be used to support the reciprocating action miller 10.

Figure 5:
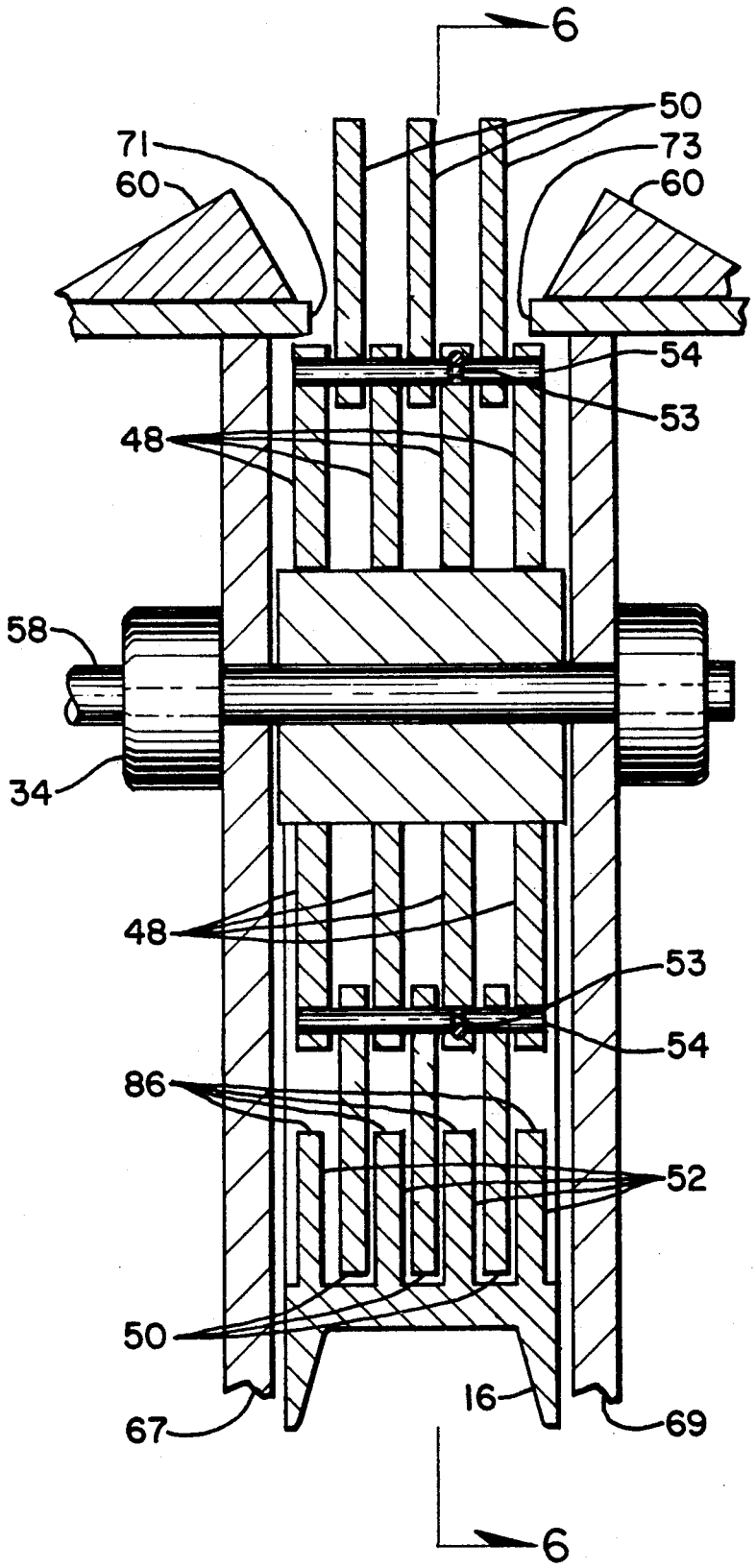
FIG. 5 is a cross-sectional view of the grinding rotor and the eccentric, adjustable stator taken along the line 5—5 of FIG. 4.

One of the significant features of this invention is the overhanging relationship of the edges 71, 73 of the opening 17 in floor 70 with respect to the grinding rotor 46, as is best seen in FIGS. 2 and 5. This overhang of the edges 71, 73 prevents material from falling into the spaces between the aft-most rotor plate 48 and aft vertical sidewall 67, or between the forward-most rotor plate 48 and forward vertical sidewall 69, as the material is being axially fed into either cutting end of the hammer mill housing 15. If material were to become lodged in these spaces, it could possibly jam the rotor 46, or at least cause rapid wear to rotor plates 48 and sidewalls 67, 69.

A plurality of triangular-shaped log ramps 60, attached to the cylindrical cross-sectioned floor 70 of hopper 12 near forward and aft edges 73, 71, guide larger chunks of refuse, such as stumps or logs radially outward toward the outermost peripheral extremitie of the rotor 46 to aid in gradually feeding such larger chunks of refuse into the rotating hammers 50 and knives 64 of rotor 46. Finer material, on the other hand, can be pushed between these ramps 60 for feeding into a larger portion of the rotor 46. The ramps 60 also tend to hold some smaller and medium-sized chunks, such as smaller branches or boards, in place while the rotor knocks off their leading ends, rather than being able to fling them away from the rotor 46.

Figure 7:
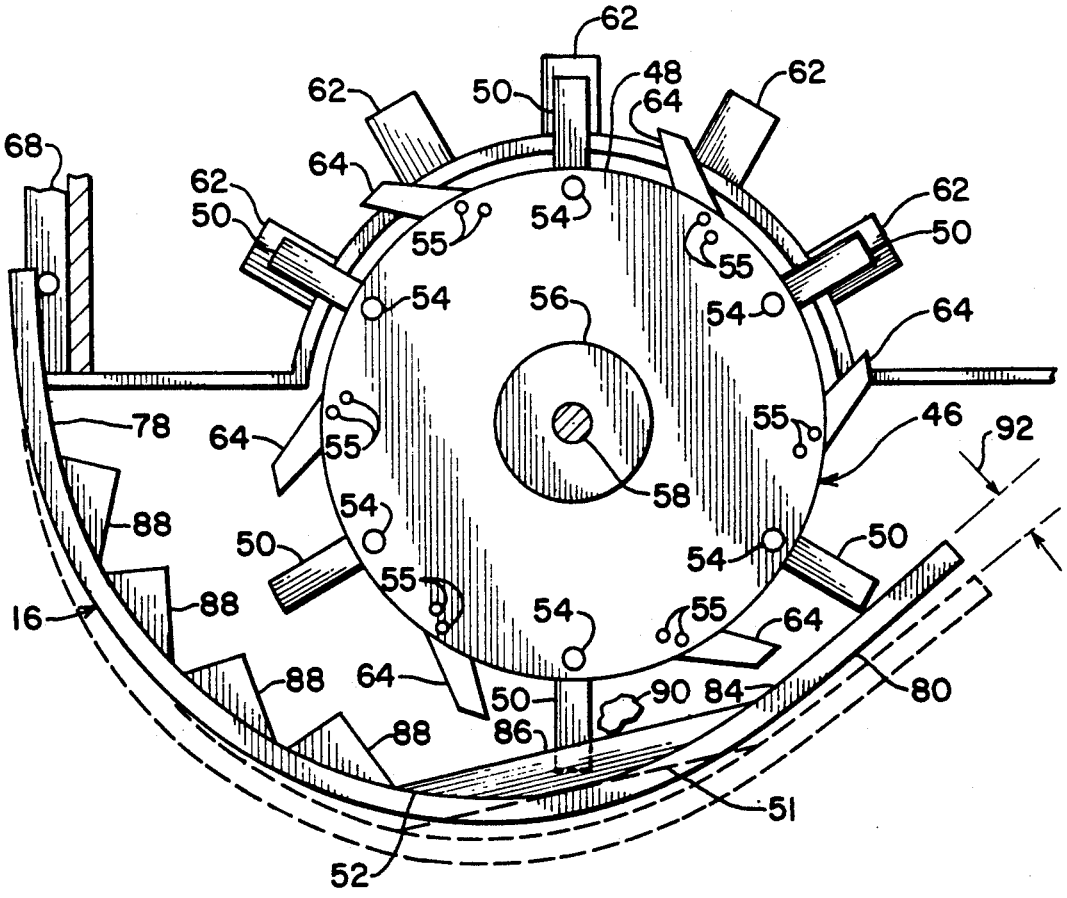
FIG. 7 is a front view in elevation of the grinding rotor and eccentric, adjustable stator, showing the position of the stator in a fine grind position and with a coarse grind position illustrated in broken lines.

Actually, these log ramps need not be of triangular cross-section, as is seen in FIGS. 2, 3, and 4, and may be of a rectangular cross-section, as in the rectangular log ramps 62, as seen in FIG. 7. However, it is important to realize that the triangular log ramps 60 oriented as shown in FIGS. 2, 3, and 4, only work well for holding chunks in place when the rotor 46 is turning in the direction indicated by arrow 76 in FIG. 4, which means that the discharge cannot be moved to the opposite side of the miller 10. However, in the preferred embodiment, the side of the miller 10 from which the comminuted material can be discharged is reversible which requires that the rotor 46 rotate in either direction depending on where the discharge side is located. In this case, the rectangular cross-section ramps 62 must be used to provide efficient holding and feeding of material, regardless of the direction of rotor rotation.

Figure 6:
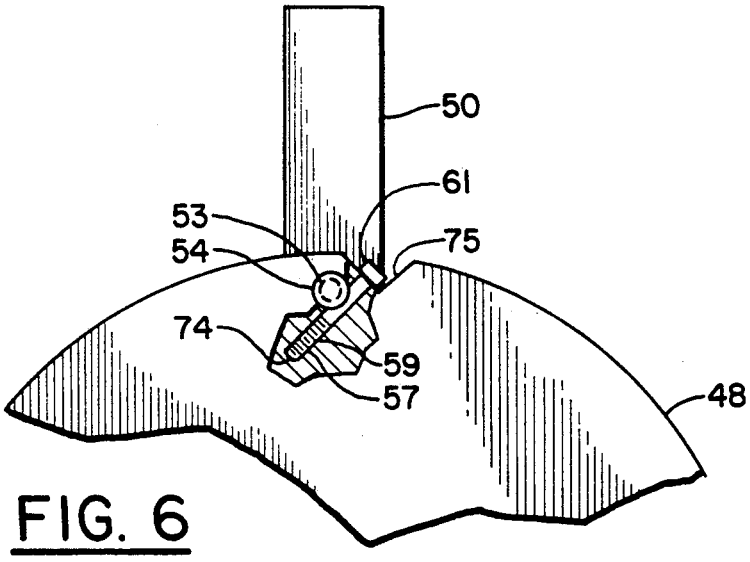
FIG. 6 is a side view in elevation of the grinding rotor taken along the line 6—6 of FIG. 5, showing how a retaining screw is used to secure a hammer pivot pin.

The details of the jam resistant grinding rotor 46 and stator 16 arrangement according to the present invention are best seen in FIGS. 5, 6, and 7. Essentially, the grinding rotor 46 comprises a plurality of rotor plates 48 attached to rotor hub 56 in parallel, spaced-apart relation, between which are mounted a plurality of pivotally mounted hammers 50 and reversible chipping knives 64. More specifically, the hammers 50 are pivotally mounted by a series of retaining pins 54 in approximately sixty (60) degree intervals around the perimeter of the rotor plates 48, which allow worn or broken hammers to be easily replaced. As is best seen in FIGS. 5 and 6, each retaining pin 54 has a substantially half-round slot, or groove 53 around its entire circumference at a location corresponding to one of the rotor plates 48. See FIG. 5. A retaining screw 57 is threaded into a hole 74 in rotor plate 48 such that the shoulder 59 of retaining screw 57 engages the groove 53 of pin 54, thereby axially retaining pin 54. A counter sink 75 in the peripheral surface of rotor plate 48 protects the head 61 of retaining screw 57 from wear during the grinding operation.

Likewise, the chipping knives 64 are mounted to the perimeter of the rotor plates substantially half way between the successive sets of hammers 50, i.e., also in approximately sixty (60) degree intervals. The chipping knives 64 are not pivotally mounted, but each is retained by two bolts 55, thus allowing for easy reversal thereof when changing the direction of rotation of rotor 46, or to allow for the easy removal and replacement of damaged or worn knives. The knives 64 can be mounted in any conventional manner, as will be readily obvious to persons having ordinary skill in the art after becoming familiar with this invention, so it is not deemed necessary to illustrate in detail any particular mounting structure for purposes of this disclosure.

Referring now to FIGS. 4 and 7, the inlet end 78 of the arcuate grinding concave or stator 16 is pivotally mounted to vertical cross member 68 of hopper 12 by pivot 150, which can be either a bolt or a pin, such that the center of curvature of the stator 16 is eccentric with respect to the center axis 72 of grinding rotor 46, thereby resulting in a continually decreasing clearance, thus decreasing grinding volume, between the hammers 50 and knives 64 and the stator 16. See FIG. 7. The outlet end 80 of stator 16 is preferably attached to and supported by an adjustable air shock 82, which is used to adjust the spacing between the hammers 50 and knives 64 and the inside grinding surface 84 of the stator 16, thus adjusting the sizes of the comminuted particles. The adjustable air shock 82 positions the stator 16, as could also be done with a hydraulic or mechanical screw-type jack, but with the additional advantage of providing a significant degree of yielding or shock absorption action in the event a heavy slug of material or a large, non-comminutable object finds its way into the grinding mill. Specifically, the air shock 82 will allow the stator 16 to pivot or move radially outward to some extent in relation to the rotor 46, thus allowing the non-comminutable object, which might otherwise jam or damage the mill, to be passed through the mill and ejected A plurality of shear plates 52 in the shape of segments of a circle are attached to the inside surface 84 of stator 16 in spaced-apart relation to each other near the outlet end 80. These shear plates 52 are positioned to extend into the periphery of the rotor 46 a sufficient distance such that the hammers 50 extend into the spaces between the shear plates, as shown in FIGS. 5 and 7. These shear plates 52 contribute to the comminution of material in the mill housing 15 as the hammers 50 force the material to shear and be torn and shredded into smaller pieces as the hammers 50 drag the material between the shear plates 52. However, the shapes and positions of the shear plates 52 in the manner shown in FIG. 7 is such that the exposed edges 86, which substantially define a chord of a circle defined by the rotor 46, provide a smoothly inclined surface for guiding hard objects 90, such as chunks of iron, rock, concrete, or the like, through the mill housing 15 and out discharge end 80 without jamming.

In the preferred embodiment, the degree of eccentricity of stator 16 with respect to center axis 72 and the adjustment range of air shock 82, are such that when air shock 82 is fully extended to produce the smallest sizes of comminuted particles, the stator 16 is in the position indicated by solid lines in FIG. 7. That is, the outboard ends 51 of hammers 50 just clear the inside surface 84 of stator 16 where the hammers 50 pass the closest to the inside surface 84, which is near the outlet end 80. This close fit in the "fine" grinding position not only grinds the refuse into relatively fine or small particles, because they are forced to pass between the close clearances between the shear plates 52, the inside surface 84, and the hammers 50, but also the hammers 50 sweep the inside surface 84 clean of nearly all residue and eject it out the discharge end 80. Conversely, when the air shock 82 is fully retracted, the stator 16 moves to the position indicated by the broken lines 16' in FIG. 7. In this "coarse" grinding position, the outboard ends 51 of the chipping hammers 50 just clear the outside edges 86 of shear plates 52. Note also that the discharge angle, indicated by arrow 92 in FIG. 7, changes little with the adjustment of the stator 16. Finally, a plurality of grinding teeth 88 can also be attached to the inside surface 84 of stator 16 between the inlet end 78 and shear plates 52 to aid in pulverizing and breaking-up the material to comminute it even finer.

The details of the reciprocating feed apparatus 14 are best seen and understood by referring to FIGS. 2, 3, and 4 simultaneously. Essentially, reciprocating feed apparatus 14 comprises a rectangularly shaped frame having two longerons 94, 95 in parallel, spaced-apart relation with forward and aft cross members 97, 96 attached at either end and having decking plates 89 attached thereover. The external perimeter of the two longerons 94, 95 is channeled to receive the guide rollers 66, which guide the frame of feed apparatus 14 within the hopper 12. See FIGS. 2 and 4. Forward and aft vertical reciprocating walls 44, 42 are attached to longerons 94, 95 and are braced by forward and aft wall braces 99 and 98. In operation, the entire feed apparatus 14 is reciprocated back and forth within hopper 12 to axially feed the refuse contained between the two walls 42 and 44 back and forth over the into either cutting end of the cylinder defined by the rotating hammers 50 and knives 64 of mill rotor 46 through cut-out 17. FIG. 3 shows the reciprocating feed apparatus 14 in its aft-most position, with forward wall 44 nearly adjacent log ramps 60. When the feed apparatus 14 is reciprocated all the way to the forward position, vertical walls 42, 44 will be in a similar positions 42', 44', as indicated by broken lines in FIG. 3. The reciprocating feed apparatus 14 is reciprocated by hydraulic cylinder 20, with the blind end of the cylinder 25 attached to cross member 21 and with piston rod 23 attached to wall 42.

As described above, the reciprocating feed apparatus 14 is actuated by hydraulic cylinder 20, which reciprocates the forward and aft vertical walls 44, 42 within the interior of the hopper 12, thus pushing and sweeping the refuse or material to be comminuted into either cutting end of the hammer mill rotor 46 to be pulled down into the mill housing 15. Reciprocation of the feed apparatus 14 can be accomplished by an electro-hydraulic system, such as that shown schematically in FIG. 8, although any other suitable control system can also be used. Essentially, a hydraulic pump 100 driven by engine 22 draws hydraulic fluid through a filter 102 from reservoir 104. The high-pressure hydraulic fluid is then pumped through an oil cooler 106 and into an auto flow control valve 108 and its associated control box. Auto flow control valve 108 can be a model A1044 Governor Valve. Then, depending on the position of the three (3) position valve 110, the fluid is either returned to the reservoir 104, or is directed to either the blind end or the rod end of the dual action hydraulic cylinder 20, which either extends or retracts the piston rod, thus reciprocating the feed apparatus 14. The position of valve 110 can be electrically controlled by two (2) solenoids 109, 111, which actuate the valve 110 to cross-feed the lines, thus extending the rod of cylinder 20, or direct-feed the lines, thus retracting the rod of cylinder 20. When neither solenoid 109, 111 is activated, the valve 110 "short circuits" the flow and returns the pressurized hydraulic fluid to the reservoir 104.

The electrical control system for activating the solenoids 109, 111 is straightforward, and comprises an engine driven alternator 200, two 12 volt storage batteries 202, 204, a latching type relay 206, two (2) normally open proximity switches 208, 210, and an on-off switch 212. Upon closing the switch 212, current flows through proximity switch 208 and through the latching relay 206, which then energizes solenoid 109, which pulls the valve 110 to the left, thus cross-feeding the hydraulic fluid to extend cylinder 20. As soon as target 228, which is attached to the reciprocating feed 14, clears proximity switch 208, switch 208 opens. However, latching relay 206 continues to energize solenoid 109 until target 230 closes proximity switch 210, which is a characteristic of latching relay 206, at which time relay 206 de-energizes solenoid 109 and energizes solenoid 111, which pulls the valve 110 to the right, and thus retracts cylinder 20, and thus reciprocating feed apparatus 14, where the process of reciprocation begins all over again.

To begin grinding, the engine 22 is started, and the rotor 46 is brought up to its operating speed. The refuse to be comminuted is then dumped into hopper 12. Closing on-off switch 212 activates the hydraulic cylinder 20 as previously discussed, which begins to reciprocate the feed mechanism 14 to move the refuse back and forth in hopper 12, thus alternately feeding the refuse into either cutting end of the rotor 46, as described above. The refuse is then drawn into the inlet end 78 of stator 16 by hammers 50, where it is pulverized, cut, torn, shredded, and otherwise comminuted by the action of the hammers 50 and knives 64 co-acting with grinding teeth 88 and shear plates 52 on the stator 16. Note that the grinding volume, or space between rotor 46 and stator 16, is constantly decreasing as the refuse travels from the inlet end 78 to the outlet end 80 of stator 16. This decreasing space provides for efficient grinding and jam-resistant operation, since the tougher, more difficult material tends to remain near the inlet end 78 of stator 16 until it has been sufficiently pulverized to travel further down the stator 16 where it is finally ejected. Of course, the sizes of the comminuted particles can be adjusted as described above by adjusting the position of stator 16 by adjustable air cylinder 82. Likewise, the position of the discharge chute 18 can be adjusted by jack 19. See FIG. 4.

Should the operator deem it necessary to have the comminuted material discharged from the opposite side of the mill 10, all he would need to do is to disconnect the inlet end 78 of stator 16 from pivot 150 (FIG. 4), and the discharge chute from pivot 152, and interchange the two, thus moving the material discharge to the opposite side. Similarly, the adjustment jacks 82 and 19 are removed from their respective pivots 154, 156, and relocated on the opposite side by pivots 158, 160, respectively. Finally, before milling can start with the changed discharge side, the rotation of the rotor 46 needs to be reversed, i.e., it needs to rotate in the direction opposite from that indicated by arrow 76 in FIG. 4. This change of direction is accomplished by reversing transmission 28 by actuating the reversing lever (not shown). Such reverse operation is facilitated in this invention with a reversible transmission 28 that operates with the same input-to-output speed ratios in both the forward and reverse directions. The mill 10 will then comminute material and discharge it from the opposite side with no loss of efficiency.

This completes the description of the structure and operation of the reciprocating miller 10 of the present invention. While the basic features have been shown and described, many modifications will become apparent to those skilled in the art, and should be considered as falling within the scope of the invention. For example, any number of rotor plates 48 could be arranged on rotor hub 56 to increase or decrease the numbers of hammers 50 and knives 64 attached thereto. Of course, if this is done, there must be corresponding changes in the numbers of shear plates 52, and in the overall width between sidewalls 67, 69, and the width of opening 17 in floor 70. Likewise, changes in the width of the stator 16 and discharge chute would also be required. It would also be possible to replace the hammers 50 and knives 64 with other devices which would pulverize the refuse. Similarly, while the hammers 50, and knives 64 used in the preferred embodiment are replaceable, which is desirable, non-replaceable hammers and knives could also be utilized. Numerous other modifications are also possible, and should also be considered as falling within the scope of the present invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be considered as falling within the scope of the invention as defined by the claims which follow.

The embodiments of the invention in which an exclusive property or privilege is claimed are defined as follows:

1. A grinding mill for comminuting refuse and ejecting it through an outlet, comprising:

grinding means mounted for rotation about a first axis such that the grinding means when rotating defines a grinding cylinder the opposite ends of which are cutting ends;

a refuse hopper defining an interior volume and having a convex floor with an opening therein to expose the refuse to said grinding means, said opening dividing said interior volume and said convex floor into forward and aft portions, and wherein said convex floor is positioned above said first axis such that said grinding means protrudes through the opening in said convex floor; and reciprocating feed means for directing the refuse to said opening and alternately into either cutting end of said grinding cylinder, said reciprocating feed means being slidably mounted in said refuse hopper along a second axis that is substantially parallel to said first axis.

2. The grinding mill of claim 1, wherein said grinding means comprises:

a cylindrical grinding motor having a longitudinal axis and a circumference, said cylindrical grinding rotor being rotatably mounted along said first axis such that the longitudinal axis of said grinding rotor substantially coincides with said first axis;

chipping means mounted to the circumference of said grinding motor for comminuting the refuse into fragments having substantially uniform sizes; and an arcuate stator having an inlet end, an outlet end, and an interior grinding surface, the interior grinding surface of said stator being positioned around a predetermined portion of the circumference of said rotor in spaced-apart relation thereby forming a material inlet area at the inlet end, a material outlet area at the outlet end, and a grinding volume therebetween, whereby the refuse is drawn into the material inlet area at the inlet end, comminuted in the grinding volume, and ejected through the material outlet area at the outlet end all by the rotation of said chipping means on said grinding rotor.

3. The grinding mill of claim 2, wherein said reciprocating feed means comprises:

first and second reciprocating walls in parallel, spaced-apart relation slidably mounted along said second axis within the interior volume of said refuse hopper, said first reciprocating wall being located and reciprocated only within the forward portion of said interior volume and said second reciprocating wall being located and reciprocated only within the aft portion of said interior volume; and linear actuating means attached to said second reciprocating wall for simultaneously moving said first and second walls back and forth within the forward and aft portions of the interior volume of said hopper, respectively, to alternately sweep the refuse from the forward and aft portions of the opening in said convex floor into said grinding means.

4. The grinding mill of claim 3, wherein said arcuate stator is eccentrically mounted with respect to said rotor such that the material inlet area at the inlet end of said stator is greater than the material outlet area at the outlet end of said stator.

5. The grinding mill of claim 4, further comprising means for adjusting the grinding volume between said arcuate stator and said rotor to adjust the sizes of the fragments of the comminuted refuse.

6. The grinding mill of claim 5, wherein the convex floor of said hopper is of cylindrical cross-section with a diameter that is slightly greater than the diameter of the circumference of said grinding rotor and positioned with respect to said grinding rotor such that the opening in the convex floor slightly overhangs the circumference of said grinding rotor while still allowing said chipping means to extend into the interior volume of said hopper.

7. The grinding mill of claim 6, further comprising means for reversing the direction of rotation of said cylindrical grinding rotor.

8. The grinding mill of claim 7, wherein the inlet and outlet ends of said stator can be interchanged, such that the comminuted refuse can be discharged from the opposite side.

9. The grinding mill of claim 8, wherein said arcuate stator is pivotally mounted at its inlet end to said refuse hopper, and wherein its outlet end is adjustably positioned by adjustable air shock means.

10. The grinding mill of claim 8, further comprising adjustable discharge means connected to the outlet of the mill for selectively changing the direction of the ejected comminuted refuse.

11. The grinding mill of claim 8, wherein said chipping means comprises a pivotally mounted hammer.

12. The grinding mill of claim 8, wherein said chipping means comprises a knife.

13. The grinding mill of claim 8, wherein said chipping means comprises, in combination, a pivotally mounted hammer and a knife.

14. The grinding mill of claim 8, further comprising:

a goose neck support chassis attached to the forward end of said hopper; and a goose neck attached to said goose neck support chassis and depending downward therefrom.

15. The grinding mill of claim 14, further comprising a maneuvering wheel attached to said goose neck.

16. The grinding mill of claim 10, wherein said pivotally mounted hammer comprises:

an elongated hammer having a proximal end and a distal end, said proximal end having a pivot hole therethrough;

an elongated pivot pin having a circumferential clearance slot substantially about its midportion and passing through said grinding rotor and the pivot hole in said elongated hammer, such that said elongated hammer is pivotally retained thereto; and a retaining screw secured to said grinding rotor along an axis substantially orthogonal to the longitudinal axis of said pivot pin, and engaging said circumferential clearance slot in said pivot pin to axially retain said pivot pin in said grinding rotor.

17. The grinding mill of claim 2, wherein the convex floor of said hopper is of cylindrical cross-section with a diameter that is substantially the same as the diameter of the circumference of said grinding rotor and positioned with respect to said grinding rotor such that the opening in the convex floor is substantially flush-aligned with the circumference of said grinding rotor while still allowing said chipping means to extend into the interior volume of said hopper.

18. The grinding mill of claim 2, wherein said arcuate stator further comprises:

a plurality of grinding teeth mounted on the interior grinding surface of said arcuate stator; and shear plate means mounted on the interior surface of said arcuate stator near the outlet end for enhancing discharge of the comminuted refuse and discouraging jamming of the mill by unbreakable refuse.

19. The grinding mill of claim 18, wherein said arcuate stator is eccentrically mounted with respect to said rotor such that the material inlet area at the inlet end of said stator is greater than the material outlet area at the outlet end of said stator.

20. The grinding mill of claim 19, further comprising means for decreasing the grinding volume and the material outlet area to a fine grind position which decreases the sizes of the fragments of the comminuted refuse, and for increasing the grinding volume and the material outlet area to a coarse grind position which increases the sizes of the fragments of the comminuted refuse.

21. The grinding mill of claim 20, wherein said chipping means comprises, in combination, a pivotally mounted hammer and a knife.

22. The grinding mill of claim 21, wherein said shear plate means comprise a plurality of plates attached along a predetermined arcuate portion of the inside surface of said stator, said plates having arcuate curved bottom surfaces such that said plates can be attached to the inside surface of said arcuate stator, and flat upper surfaces which together define a planar top surface, said plates also being positioned in parallel, spaced-apart relation on the inside surface of said stator to define a hammer clearance space therebetween that is substantially parallel to the path of said pivotally mounted hammer as it is rotated by said grinding rotor, and wherein said plates are sized such that said pivotally mounted hammer passes substantially completely through the hammer clearance space, said pivotally mounted hammer just contacting the inside surface of said stator when said stator is in the fine position, and such that said pivotally mounted hammer substantially passes over the planar top surface defined by the top surfaces of said plurality of plates when said stator is in the coarse position.

23. A method of comminuting material in a hopper with a grinding rotor that has a set of hammers mounted on said grinding rotor in such a manner that rotation of the grinding rotor about an axis of rotation defines a cylinder, most of which cylinder is in a housing that is adjacent and opens into said hopper and a portion of which cylinder extends into said hopper, comprising the steps of:

feeding material to be comminuted substantially parallel to said axis of rotation into the opposite ends of said cylinder;

pulling the material into the portion of the volume defined by the hammers of said rotating cylinder in said housing;

comminuting the material within said housing to produce milled material; and ejecting the milled material from the housing.

24. Comminuting apparatus for comminuting material, comprising:

a rotor with comminuting projections extending radially outward and mounted to rotate on a rotation axis in such a manner that the rotor when rotating defines a rotor cylinder, either end of which is a cutting end;

rotor drive means for rotating said rotor about said rotation axis;

a mill housing substantially surrounding said rotor cylinder, but leaving a portion of the periphery of the rotor cylinder exposed;

a hopper positioned over said mill housing in such a manner that the exposed portion of the periphery of the rotor cylinder extends into said hopper, said hopper being adapted to receive and contain material to be comminuted; and reciprocating feed means for moving said material in said hopper in a reciprocal manner into either cutting end of the rotor cylinder.

25. The comminuting apparatus of claim 24, wherein said reciprocating feed means is oriented to move said material to be comminuted in a reciprocal manner in directions substantially parallel to said rotation axis.

26. A method of comminuting material, comprising the steps of:

rotating a rotatable comminuting rotor having projections extending radially outward about a rotation axis in such a manner that said rotor and projections define a rotor cylinder, either end of which is a cutting end;

positioning material to be comminuted adjacent and in contact with either cutting end of said rotor cylinder; and moving said material substantially parallel to said rotation axis in a reciprocal manner back and forth in relation to said rotor cylinder allowing said projections to contact and comminute said material.

27. The method of claim 26, including the step of allowing said projections to propel said material through spaces between a plurality of shear plates in said housing that are positioned to protrude into a portion of the peripheral surface of said rotor cylinder to an extent that defines a segment section of said rotor cylinder.

* * * * *